US005988801A

United States Patent [19]

Coiner

[11] Patent Number: 5,988,801

[45] Date of Patent: Nov. 23, 1999

[54] HIGH PERFORMANCE TUBING FOR INKJET PRINTING SYSTEMS WITH OFF-BOARD INK SUPPLY

[75] Inventor: Erich E. Coiner, Poway, Calif.

[73] Assignee: Hewlett-Packard Company, Palo Alto, Calif.

[21] Appl. No.: 08/724,617

[22] Filed: Sep. 30, 1996

[51] Int. Cl.[6] ..... B41J 2/175

[52] U.S. Cl. ..... 347/85

[58] Field of Search ..... 347/85–87, 84; 138/137, 140, 141

[56] References Cited

U.S. PATENT DOCUMENTS

| | | | |
|---|---|---|---|
| 3,102,770 | 9/1963 | McKeegan . | |
| 4,394,669 | 7/1983 | Ozawa et al. . | |
| 4,475,116 | 10/1984 | Sicking et al. | 347/86 |
| 4,528,576 | 7/1985 | Koumura et al. . | |
| 4,540,996 | 9/1985 | Saito . | |
| 4,628,332 | 12/1986 | Matsumoto | 347/85 |
| 4,672,432 | 6/1987 | Sakurada et al. | 358/75 |
| 4,684,962 | 8/1987 | Hirosawa et al. . | |
| 4,775,868 | 10/1988 | Sugiura | 346/46 |
| 4,806,956 | 2/1989 | Nishikawa et al. . | |
| 4,831,389 | 5/1989 | Chan . | |
| 4,905,024 | 2/1990 | Nishikawa et al. . | |
| 4,926,196 | 5/1990 | Mizoguchi . | |
| 4,929,963 | 5/1990 | Balazar . | |
| 5,025,270 | 6/1991 | Umezawa . | |
| 5,043,746 | 8/1991 | Abe . | |
| 5,469,201 | 11/1995 | Erickson et al. | 347/85 |

FOREIGN PATENT DOCUMENTS

| | | | |
|---|---|---|---|
| 55-42858 | 3/1980 | Japan . | |
| 357210879A | 12/1982 | Japan . | |
| 58-51156A | 3/1983 | Japan . | |
| 358194563A | 11/1983 | Japan . | |
| 58-208061 | 12/1983 | Japan . | |
| 60-232964 | 11/1985 | Japan . | |
| 360264255A | 12/1985 | Japan . | |
| 60-264255 | 12/1985 | Japan . | |
| 61-5950A | 1/1986 | Japan . | |
| 61-27259 | 2/1986 | Japan . | |
| 62-116152 | 5/1987 | Japan . | |
| 362152885A | 7/1987 | Japan . | |
| 362220341A | 9/1987 | Japan . | |
| 62-218136 | 9/1987 | Japan . | |
| 62-288045 | 12/1987 | Japan | 347/85 |
| 363147651A | 6/1988 | Japan . | |
| 363154354A | 6/1988 | Japan . | |
| 2-62494 | 3/1990 | Japan | 138/140 |
| 2-111555 | 4/1990 | Japan | 347/85 |
| 1110944 | 4/1968 | United Kingdom | 138/137 |

*Primary Examiner*—N. Le
*Assistant Examiner*—Judy Nguyen
*Attorney, Agent, or Firm*—Dennis G. Stenstrom

[57] ABSTRACT

An off-carriage printing system with high performance tubing. The printing system includes a media transporting system for transporting a print medium along a medium path to a print area, a scanning carriage for holding a printing structure including a printhead, and a scanning apparatus for scanning the carriage along a scanning axis transverse to the media path at the print area. The system further includes fixed ink supply station including an ink reservoir. A fluid conduit for the flow of ink, interconnects between the ink reservoir of the fixed ink supply station and the printing structure, the fluid conduit including a length of hollow flexible multiple layer tubing routed such that a flexible loop is formed therein. The multiple layer tubing comprises at least one inner barrier layer to water vapor transmission from the ink, at least one barrier layer to oxygen permeability, and at least one outer barrier layer to water vapor transmission from the atmosphere.

26 Claims, 6 Drawing Sheets

HIGH PERFORMANCE TUBING FOR INKJET PRINTING SYSTEMS WITH OFF-BOARD INK SUPPLY

This application is related to the commonly assigned applications: "Ink-jet Printing System with Off-Axis Ink Supply and High Performance Tubing," Ser. No. 08/706,061 now abandoned, "Compliant Ink Interconnect Between Print Cartridge and Carriage", Ser. No. 08/706,045 filed on Aug. 30, 1996, and "Fluidic Delivery System with Tubing and Manifolding for an Off-Axis Printing System," Ser. No. 08/706,060 filed on Aug. 30, 1996, the entire contents of which are herein incorporated by reference.

TECHNICAL FIELD OF THE INVENTION

This invention relates to ink-jet printers, and more particularly to a printing system employing off-carriage ink supplies connected to a carriage mounted pen via tubing and manifolding and still more particularly to an off-carriage ink supply system employing high performance tubing.

BACKGROUND OF THE INVENTION

Thermal inkjet hardcopy devices such as printers, graphics plotters, facsimile machines and copiers have gained wide acceptance. These hardcopy devices are described by W.J. Lloyd and H.T. Taub in "Ink Jet Devices," Chapter 13 of *Output Hardcopy Devices* (Ed. R.C. Durbeck and S. Sherr, San Diego: Academic Press, 1988) and U.S. Pat. Nos. 4,490,728 and 4,313,684. The basics of this technology are further disclosed in various articles in several editions of the *Hewlett-Packard Journal* [Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994)], incorporated herein by reference. Inkjet hardcopy devices produce high quality print, are compact and portable, and print quickly and quietly because only ink strikes the paper.

An inkjet printer forms a printed image by printing a pattern of individual dots at particular locations of an array defined for the printing medium. The locations are conveniently visualized as being small dots in a rectilinear array. The locations are sometimes "dot locations", "dot positions", or pixels". Thus, the printing operation can be viewed as the filling of a pattern of dot locations with dots of ink.

Inkjet hardcopy devices print dots by ejecting very small drops of ink onto the print medium and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

The typical inkjet printhead (i.e., the silicon substrate, structures built on the substrate, and connections to the substrate) uses liquid ink (i.e., dissolved colorants or pigments dispersed in a solvent). It has an array of precisely formed orifices or nozzles attached to a printhead substrate that incorporates an array of ink ejection chambers which receive liquid ink from the ink reservoir. Each chamber is located opposite the nozzle so ink can collect between it and the nozzle. The ejection of ink droplets is typically under the control of a microprocessor, the signals of which are conveyed by electrical traces to the resistor elements. When electric printing pulses heat the inkjet firing chamber resistor, a small portion of the ink next to it vaporizes and ejects a drop of ink from the printhead. Properly arranged nozzles form a dot matrix pattern. Properly sequencing the operation of each nozzle causes characters or images to be printed upon the paper as the printhead moves past the paper.

The ink cartridge containing the nozzles is moved repeatedly across the width of the medium to be printed upon. At each of a designated number of increments of this movement across the medium, each of the nozzles is caused either to eject ink or to refrain from ejecting ink according to the program output of the controlling microprocessor. Each completed movement across the medium can print a swath approximately as wide as the number of nozzles arranged in a column of the ink cartridge multiplied times the distance between nozzle centers. After each such completed movement or swath the medium is moved forward the width of the swath, and the ink cartridge begins the next swath. By proper selection and timing of the signals, the desired print is obtained on the medium.

Color inkjet hardcopy devices commonly employ a plurality of print cartridges, usually either two or four, mounted in the printer carriage to produce a full spectrum of colors. In a printer with four cartridges, each print cartridge contains a different color ink, with the commonly used base colors being cyan, magenta, yellow, and black. In a printer with two cartridges, one cartridge usually contains black ink with the other cartridge being a tri-compartment cartridge containing the base color cyan, magenta and yellow inks. The base colors are produced on the media by depositing a drop of the required color onto a dot location, while secondary or shaded colors are formed by depositing multiple drops of different base color inks onto the same dot location, with the overprinting of two or more base colors producing the secondary colors according to well established optical principles.

For many applications, such as personal computer printers and fax machines, the ink reservoir has been incorporated into the pen body such that when the pen runs out of ink, the entire pen, including the printhead, is replaced.

However, for other hardcopy applications, such as large format plotting of engineering drawings, color posters and the like, there is a requirement for the use of much larger volumes of ink than can be contained within the replaceable pens. Therefore, various off-board ink reservoir systems have been developed recently which provide an external stationary ink supply connected to the scanning cartridge via a tube. The external ink supply is typically known as an "off-axis," "off-board," or "off-carriage" ink supply. While providing increased ink capacity, these off-carriage systems also present a number of problems. The space requirements for the off-carriage reservoirs and tubing impact the size of the printer, with consequent cost increase. Moreover, pressure drops through the tubing can reduce printer throughput and affect printing quality. Another problem is that of vapor losses from the tubing and air diffusion into the tubing system. In the past, tubing such as LDPE (low density polyethylene) has been used, since it is a low modulus material which is easy to bend. This low modulus material suffers from relatively high vapor losses out of the tube and air diffusion into the tube. As a result of the vapor losses, the ink can change properties, degrading print quality and eventually causing tube or printhead clogging. As a result of air ingestion, the printhead can fill with air. During thermal fluctuations, the air can expand, causing printhead drool. In addition, the air can cause printhead starvation. Further problems include the force exerted on the carriage by the tubing, and the stresses on the tubing that tends to cause buckling or fatigue failures. These problems are exacerbated with a low end off-carriage printing system with its relatively small form factor.

It would therefore be an advantage to provide a compact, low end off-carriage printing system.

It would further be advantageous to provide such a printing system which permits high throughput printing, with relatively high flow rates through the tubing.

Still other advantages would be provided by an off-carriage printing system with high reliability due to low vapor losses and air diffusion, yet with minimal tubing pressure drops while minimizing the force exerted by the tubing on the carriage to maintain accurate printhead alignment.

SUMMARY OF THE INVENTION

An off-carriage printing system with high performance tubing is described. The printing system includes a media transporting system for transporting a print medium along a medium path to a print area, a scanning carriage for holding a printing structure including a printhead, and a scanning apparatus for scanning the carriage along a scanning axis transverse to the media path at the print area. The system further includes a fixed off-carriage ink supply station including an ink reservoir. A fluid conduit for the flow of ink, interconnects between the ink reservoir of the fixed ink supply station and the printing structure, the fluid conduit including a length of hollow flexible multiple layer tubing routed such that a flexible loop is formed therein. The multiple layer tubing comprises at least one inner barrier layer to water vapor transmission from the ink, at least one barrier layer to oxygen permeability, and at least one outer barrier layer to water vapor transmission from the atmosphere.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

An exemplary application for this invention is in an off-carriage ink delivery system for either a low end printing system or a large format printer. In the exemplary system, a scanning carriage moves a print head that fires ink drops in a dot matrix pattern onto a paper or other print medium. The print head is in fluid communication with a replaceable ink supply which is releasably mounted in a fixed ink supply station. Objectives of this system include the following:

(1) to provide an off-carriage ink delivery system for either a compact, low end printing system or a large format printing system;

(2) to allow high throughput printing, with high flow rates through the tubing;

(3) to minimize pressure drops through the tubing;

(4) to maintain accurate print head alignment, by minimizing the forces exerted by the tubing on the print head carriage; and (5) most importantly, to provide high reliability, through very low vapor losses out of the fluid conduit and very low air diffusion into the fluid conduit.

Figure 1:
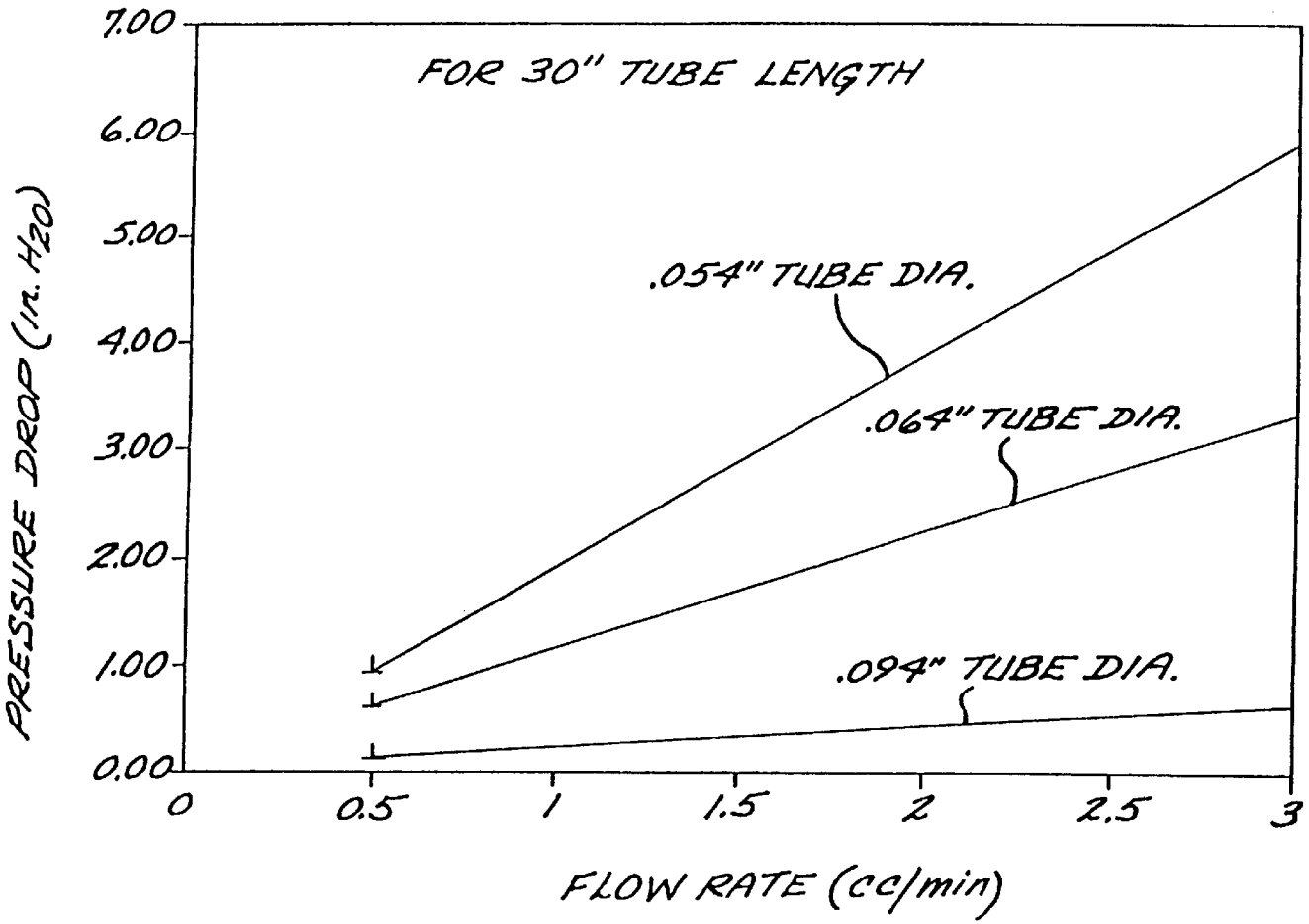
FIG. 1 is a graph showing results of characterization efforts of flow rates as a function of tube diameter for exemplary 3 centipoise ink.

The tubing requirements add to the difficulty of meeting these objectives. In order to minimize pressure drops, tubing with diameters larger than 0.050 inch ID (inner diameter) are desired, with a preferred inner diameter of 0.094 inches ID or larger for minimizing pressure drops. FIG. 1 is a graph showing results of characterization efforts of flow rates as a function of tube diameter for exemplary 3 centipoise ink. Moreover tube fitments become difficult when the diameter is below 0.0625 (1/16) inches. Smaller tubes are desired in order to allow for tube routing, since larger tubes exert more force and tend to kink when bent around tight corners.

The effect of larger diameters and high modulus tubing materials has two deleterious effects. First, it sets a low limit on the radius of the tubing, which impacts printer size. Going below a certain bend radius increases the force exerted by the tubing on the carriage, which will adversely affect carriage alignment. In addition, the low bend radius can result in tubing buckling or fatigue failures. This militates toward smaller diameter tubing.

The tubing used in the ink delivery system should meet several objectives. It should have a very low vapor transmission rate (VTR) and very low air diffusion. The tubing modulus should be minimized to the extent possible while meeting the other objectives to minimize the force exerted on the carriage. The tubing should operate for many cycles of the carriage scanning back and forth, e.g. for millions of cycles for some applications, without failure. Finally, the tubing should be very low cost.

Figure 2:
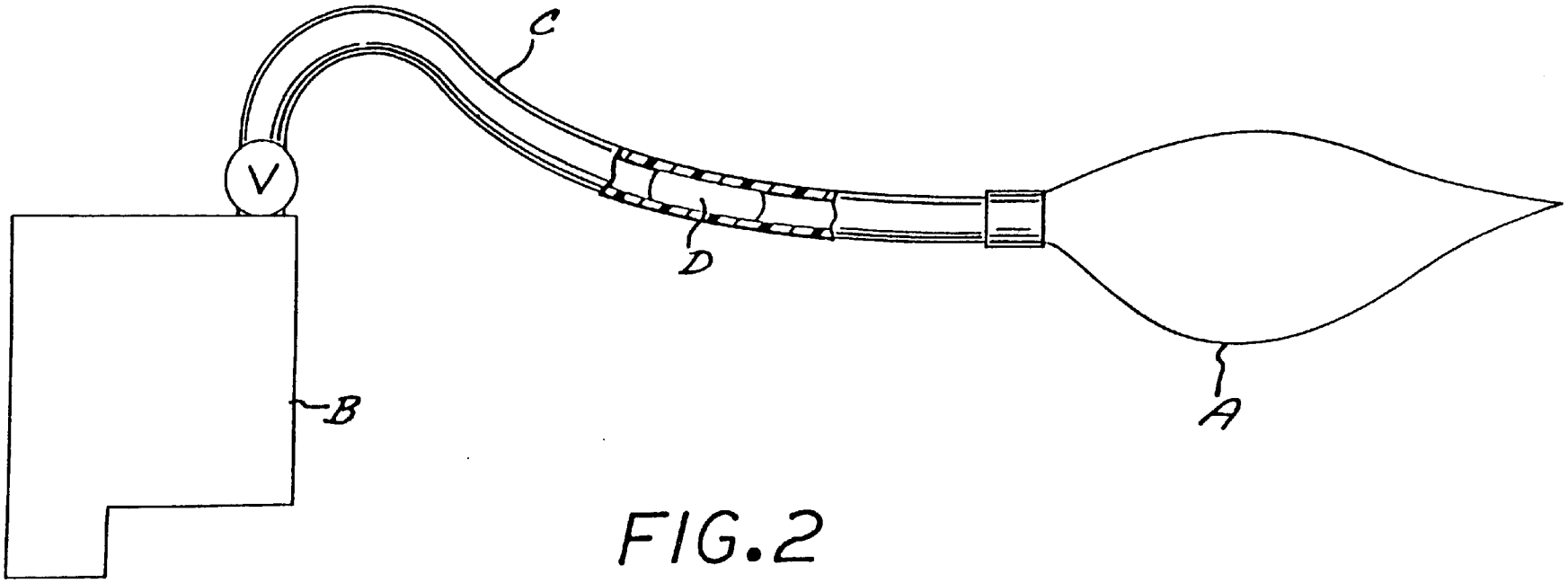
FIG. 2 is a simplified schematic diagram of a printer cartridge connected via a length of tubing to an off-carriage ink reservoir represented as a flaccid bag, with an air bubble in the tubing to illustrate an air diffusion problem addressed by an aspect of the invention.

Air diffusion into the tubing is a more difficult problem to eliminate than that of volatiles escaping from the tubing and the ink partially concentrating and even partially drying in the tubing. Air ingestion is the growth of bubbles that are pre-existing in the tubing that is in fluid communication with a flaccid bag. The problem is illustrated in FIG. 2. Consider ink held in a flaccid closed bag A, and connected to a printing cartridge B through a tube C with an air bubble D. The outside atmosphere, the total pressure in the bag, and the bubble total pressure are equalized (assume they are level and static):

$$P_{tot,tube}=P_{tot,bag}=P_{tot,outside}$$

Now, total pressure equals air (primarily oxygen and nitrogen, not counting vapors) pressure plus partial pressure of vapor:

$$P_{tot,tube}=P_{air,tube}+P_{vapor,tube}=P_{air,outside}+P_{vapor,outside}$$

Thus, $$(P_{air,outside}-P_{air,tube})=(P_{vapor,tube}-P_{vapor,outside})$$

Now, the vapor air in the tube is fully saturated; however, the pressure of vapor outside may vary. In Arizona, for example, the vapor pressure may be very low. In Florida, it would typically be very high. In very dry environments, such as Arizona, the diffusion rate of air can be very high. With low performance tubing materials, the tubes can fill with air in a few days. The air in the tubing will be drawn into the print cartridge, causing starvation of the printhead or dysfunction of the regulator.

There are many polymeric materials that have low oxygen permeability as described below. Unfortunately they are highly crystalline and hence very stiff. Also to make a tube kink resistant the wall thickness must be increased. Both of these factors means that it is very difficult for a tube that is made of a single material to meet the simultaneous requirements of low permeability and high flexibility.

Figure 3:
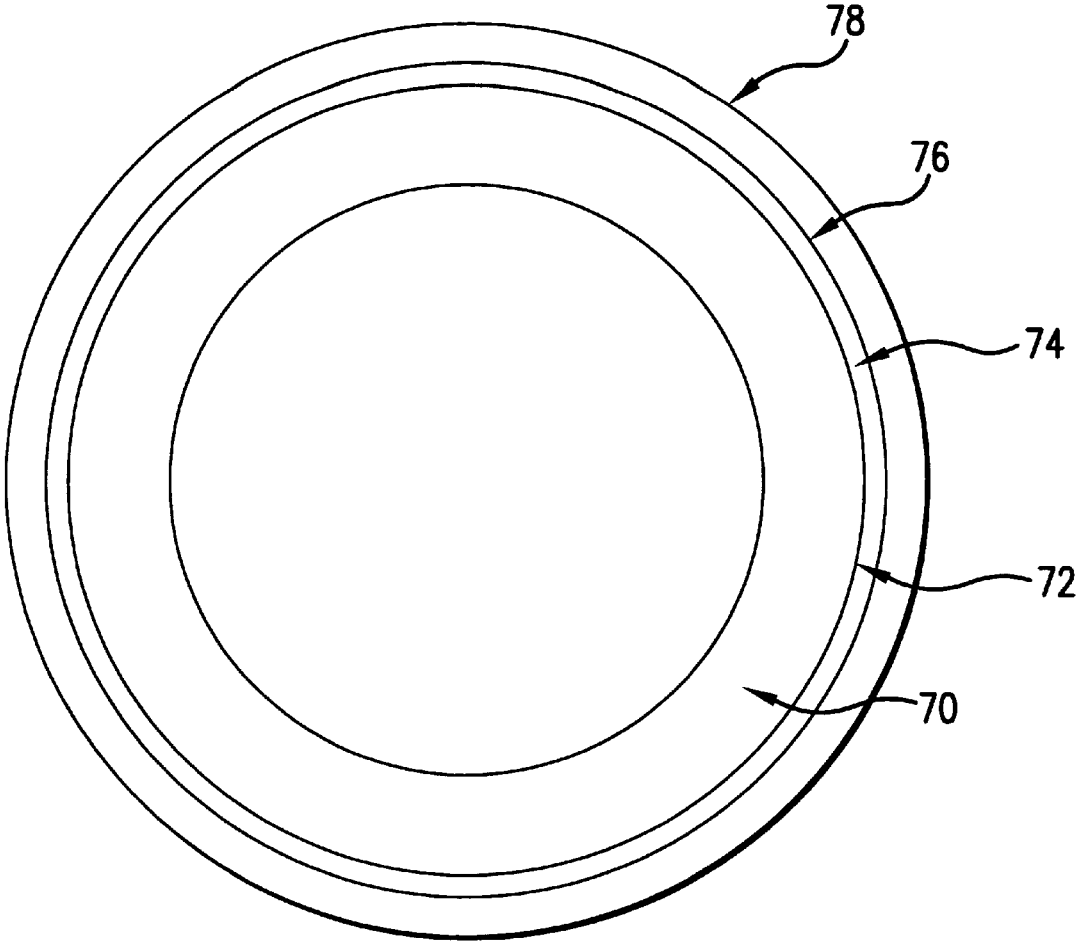
FIG. 3 is a cross-sectional view of the fluid conduit of the present invention.

In accordance with the present invention, a multi layer tubing has been employed in a printing system which meets the above objectives. Shown in FIG. 3 is a presently preferred multi layer material tubing having three concentric layers suitable for meeting the above specifications. The multi layer material tubing has an inside diameter of between 0.100 and 0.180 inches or between 0.100 and 0.200 inches. Layer 70 is low density polyethylene (LDPE), or any other Polyolefin. These materials are chemically compatible with most inks for inkjet printers. This layer acts as the primary water vapor barrier. Layer 70 has a thickness of approximately 0.015 to 0.050 inches inch to 0.03 inch. Other suitable materials for layer 70 are high density polyethylene and polypropylene.

Layer 72 is a tie layer which functions as an "adhesive" to adhere layer 70 to layer 74. This tie layer is only required if the materials of layer 70 and layer 74 are not compatible with each other. A suitable adhesive for layer 72 when layer 70 is LDPE and layer 74 is ethylene vinyl alcohol (EVOH) is "BYNEL" which is sold by DuPont. Suitable adhesive materials for two incompatible layers are well known to those skilled in the art. Layer 72 is approximately 0.0005 to 0.0015 inches in thickness.

Layer 74 is ethylene vinyl alcohol (EVOH). This material has extremely low oxygen permeability and acts as an oxygen barrier material. However, EVOH is hygroscopic and when it absorbs water it loses its low oxygen permeability.

Accordingly, water vapor transmission into EVOH must be prevented. Layers 70 and 78 provide water vapor protection from the ink and the atmosphere, respectively. Layer 74 has a wall thickness in the range of 0.0005 inch to 0.0100 inch, and in one embodiment is approximately 0.001 to 0.005 inches in thickness to meet oxygen permeability specifications. Another suitable material for layer 74 is Polyvinylidene Chloride copolymer (PVDC).

Layer 76 is a tie layer which functions as an "adhesive" to adhere layer 74 to layer 78. This adhesive layer is only required if the materials of layer 74 and layer 78 are not compatible with each other. A suitable adhesive for layer 76 when layer 74 is ethylene vinyl alcohol (EVOH) and layer 78 is ethylene vinyl acetate (EVA) is "BYNEL." Other suitable adhesive materials are well known to those skilled in the art. Layer 76 is approximately 0.0005 to 0.0015 inches in thickness. If layers 70 and 78 are chemically similar to each other, the same material to be used as the tie material in layers 72 and 76.

Layer 78 is Ethylene Vinyl Acetate (EVA). Layer 78 performs two functions, first to protect layer 76 from exterior moisture and second to build up the thickness of the tube to prevent kinking of the tube in use. EVA is inexpensive and it is available with a low modulus of elasitisity which makes it very flexible. Layer 78 has a wall thickness in the range of 0.008 inch to 0.012 inch, and in one embodiment thickness of from 0.005 to 0.020 inches. Other suitable materials for layer 78 are LDPE high density polyethylene and polypropylene.

The tubing is manufactured using known extrusion processes for making tubing. There are typically additional standard polymer materials added to aid in the extrusion process or provide additional important properties such as flexibility; the addition of such materials is known in the art.

Figure 4:
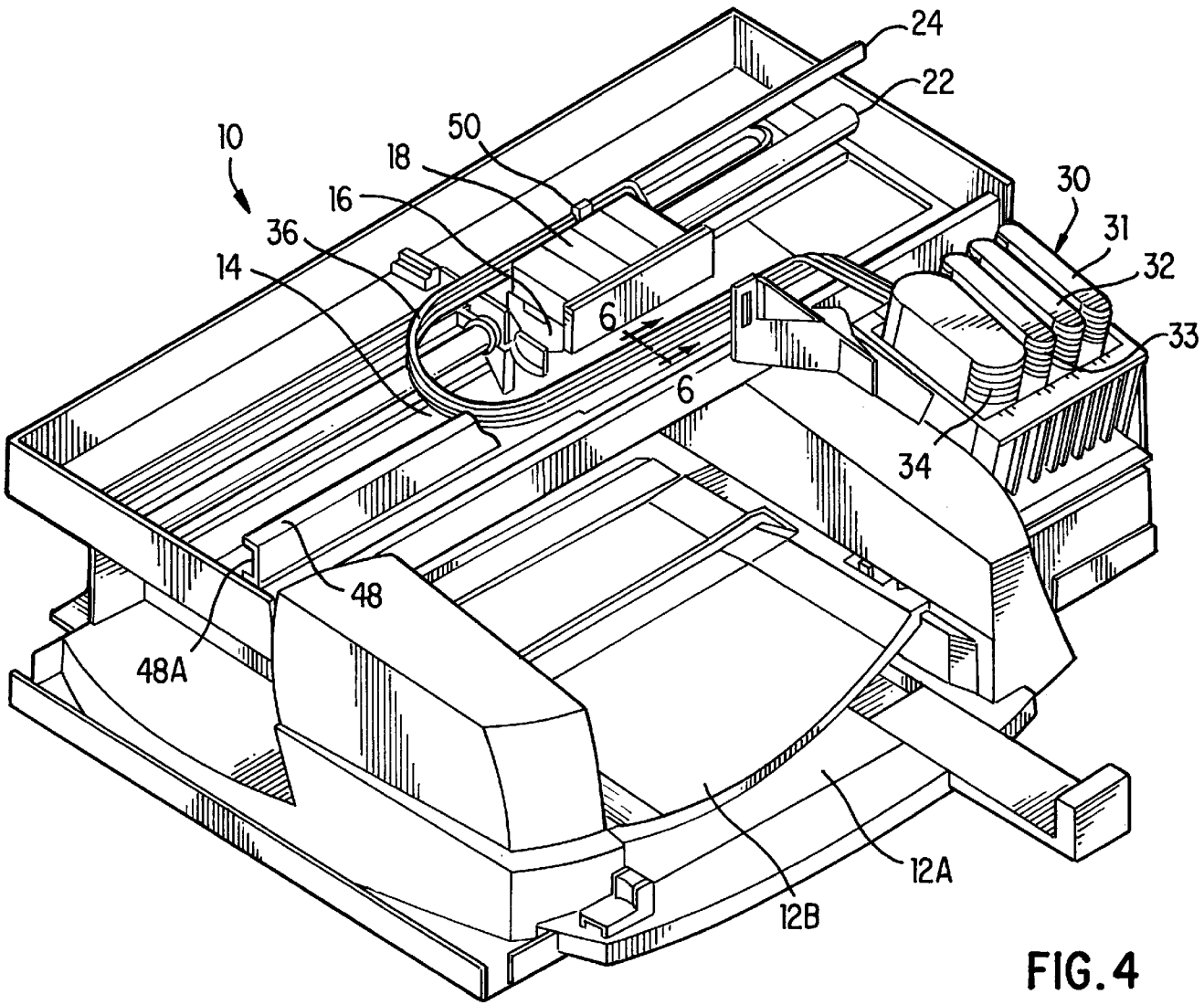
FIG. 4 is a perspective view of a color ink-jet printer embodying the invention, with its cover removed.

Turning now to FIG. 4, a perspective view is shown of an exemplary embodiment of an ink-jet printer embodying the invention, with its cover removed. Generally the printer 10 includes a tray 12A for holding an input supply of paper or other print media. When a printing operation is initiated, a sheet of paper is fed into the printer using a sheet feeder, and then brought around in a U direction to travel in the opposite direction toward output tray 12B. The sheet is stopped in a print zone 14, and a scanning carriage 16, containing one or more print cartridges 18, is then scanned across the sheet for printing a swath of ink thereon. After a single scan or multiple scans, the sheet is then incrementally shifted using a stepper motor and feed rollers (not shown in FIG. 4) to a next position within the print zone 14, and carriage 16 again scans across the sheet for printing a next swath of ink. When printing on the sheet is complete, the sheet is forwarded to a position above the tray 12B, held in that position to ensure the ink is dry, and then released.

Alternate embodiments of the printer include those with an output tray located at the back of the printer 10, where the sheet of paper is fed through the print zone 14 without being fed back in a U direction.

The carriage 16 scanning mechanism may be conventional, and generally includes a slide rod 22, along which carriage 16 slides, and a coded strip 24 which is optically detected by a photo detector in carriage 16 for precisely positioning carriage 16. A stepper motor (not shown), connected to carriage 16 using a conventional drive belt and pulley arrangement, is used for transporting carriage 16 across print zone 14.

Novel features of the inkjet printer 10 relate to the ink delivery system for delivering ink to the print cartridges 18 from an off-carriage ink supply station 30 containing replaceable ink supply cartridges 31, 32, 33 and 34. For color printers, there will typically be a separate ink supply station for black ink, yellow ink, magenta ink, and cyan ink. Since black ink tends to be depleted most rapidly, the black ink supply 34 has a larger capacity than the capacities of the other ink supplies 31–33.

A tubing set 36 of four tubes 38, 40, 42 and 44 carry ink from the four off-carriage ink supply cartridges 31–34 to the four print cartridges 18. In accordance with the invention, the tubes 38–44 comprise the multi layer tube as described above. Such tubing materials provide the necessary barrier to air diffusion, and meet the other criteria discussed above for the tubing.

Figure 5:
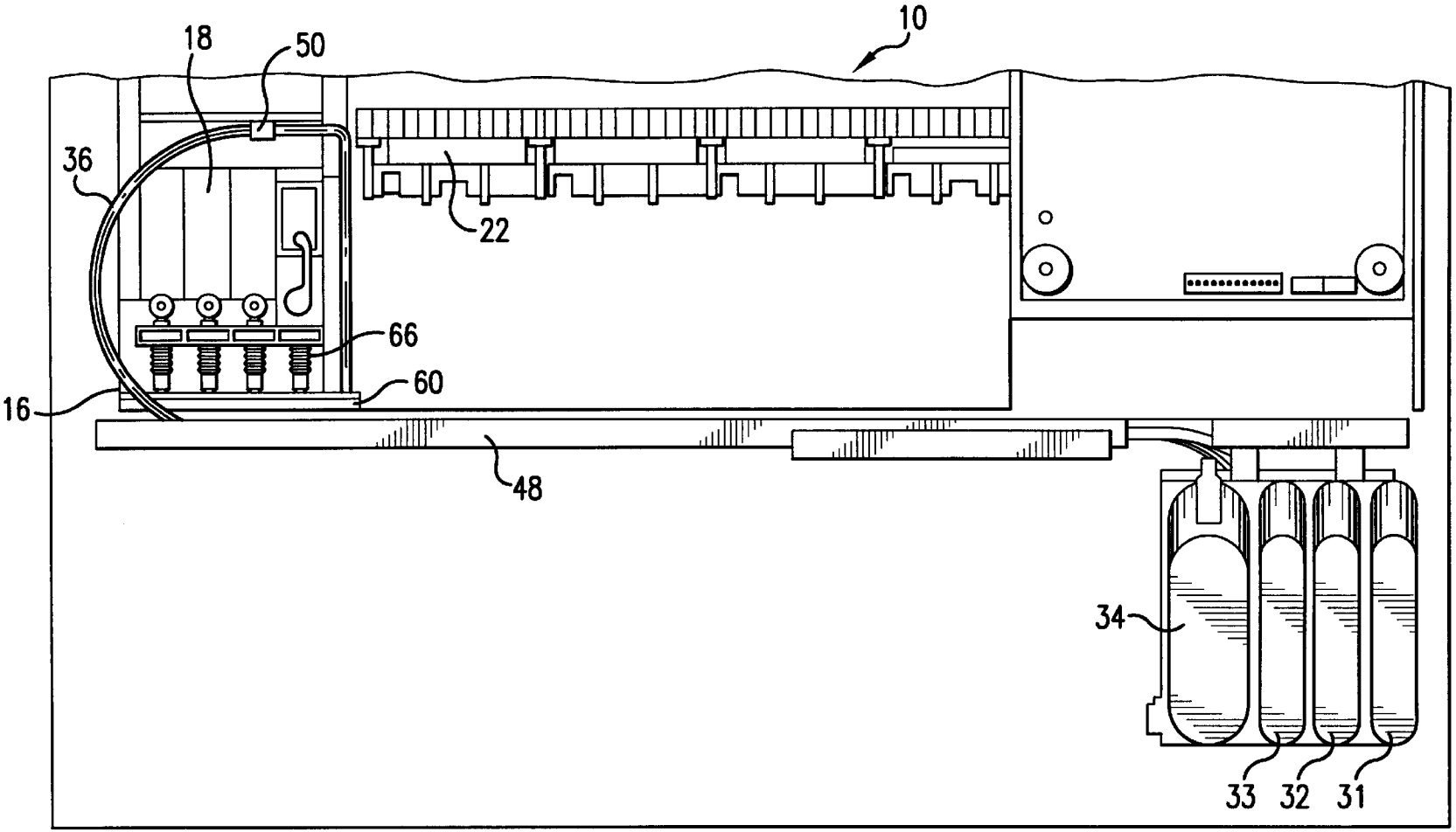
FIG. 5 is a simplified, partial top view of the printer of FIG. 4, showing a routing of the ink supply tubes from the off-carriage ink reservoirs to the carriage-mounted ink cartridges.
Figure 6:
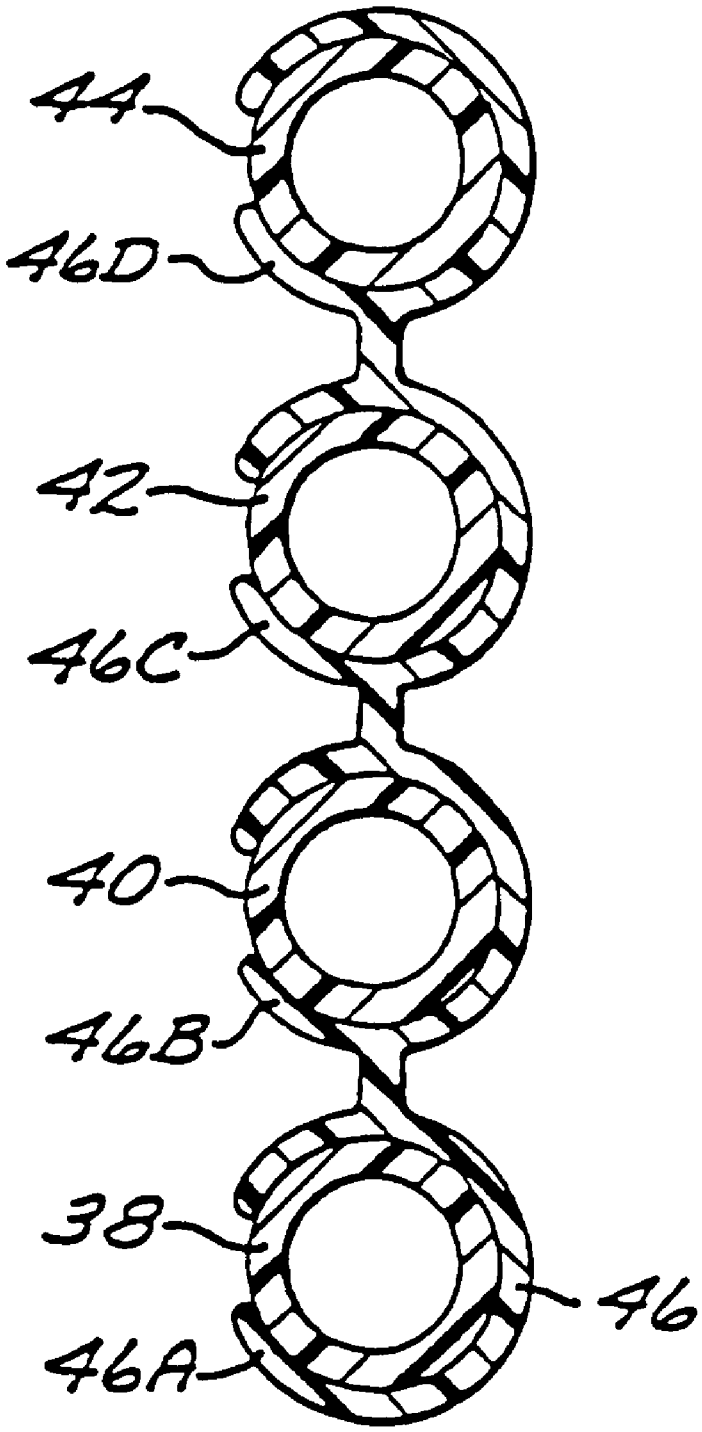
FIG. 6 is a cross-sectional view of a fluid conduit set of the printing system of FIG. 4, taken along line 6—6 of FIG. 4.

FIG. 5 is a top view of the printer 10 of FIG. 4. This shows the tube routing of the tubing set 36 according to a further aspect of the invention. The tube routing is designed to accommodate the tubing set while minimizing the space needed for the tubing set 36 to follow the carriage 16 along its scanning path. In this exemplary embodiment, the tubes 38–44 are secured together in a flat ribbon intermediate the tube ends. This can be achieved by a flexible tubing carrier 46, fabricated of a flexible plastic material with tube-receiving channels 46A–46D formed therein, sized so that the individual tubes snap fit into the channels, as shown in FIG. 6. An exemplary material for fabrication of the tube carrier is polyurethane. Alternatively, the four tubes 38–44 can be fabricated of an integral extrusion, wherein the tubes are joined together by portions of the extrusion.

The tubing set 36 runs from the individual off-carriage cartridges 31–34 to the carriage mounted cartridges 18 in a run length of approximately 25 to 30 inches for a small printer, with about 26–28 inches in the exemplary embodiment. The inner tube diameter is in the range of 0.030 to 0.150 inches, depending on the required ink flow rates, with 0.054 to 0.094 inches the preferred range, and about 0.064 inches an exemplary preferred diameter of the tubing for the printer 10. The tubing outer wall thickness is preferably in the range of 0.010 inch to 0.020 inch, with a preferred value of 0.015 inches. The tubing bend stress versus air diffusion requirements tends to define this value.

The tubing set 36 runs in a channel guide 48 which is open along a side facing the print zone 14. A clamp (not shown) located at the off-carriage supply end of the channel guide secures the position of the tubing set 36 relative to this end of the guide. The channel guide 48 constrains the tubing set 36 such that it cannot move further away from the print zone 14 than the upright wall 48A of the member 48, yet permits the tubing set 36 to move out of the channel guide-as needed to follow the movement of the carriage 16.

The tubing set 36 is clamped upright to the carriage 16 by a stress relief clamp 50, and so the tubing set 36 includes an off-carriage portion and an on-carriage portion divided by the clamp 50. The tube carrier 46 terminates at the stress relief clamp. The tubing set 36 is bent upwardly in this exemplary embodiment from the level of the carriage 16 to the level of the channel member 48. This upward curve is accomplished by bending the tubes 38–44 to make the transition from a horizontal plane at carriage level to an upper horizontal plane at the channel guide 48. Downstream of the clamp 50, the ends of the tubes 38–44 are respectfully connected to input ports of a plastic manifold 60, which routes the ink through corresponding channels to manifold output ports (not shown). The manifold output ports are in turn then fluidically coupled to the corresponding print cartridges 18 via ink couplers 66 and needle/septum arrangements. Further details are more particularly described in the co-pending applications, "Ink-jet Printing System with Off-Axis Ink Supply and High Performance Tubing," Ser. No. 08/706,061, now abandoned; "Compliant Ink Interconnect Between Print Cartridge and Carriage," Ser. No. 08/706,045 filed on Jun. 30, 1996, and "Fluidic Delivery System with Tubing and Manifolding for an Off-Axis Printing System," Ser. No. 08/706,060 filed on Jun. 30, 1996, which are herein incorporated by reference.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A printing system, comprising:

a scanning carriage for holding a printing structure;

a scanning apparatus coupled to the carriage for scanning the carriage along a scanning axis;

an off-carriage ink supply station having an ink reservoir;

a fluid conduit for a flow of ink, interconnecting between the ink reservoir of the off-carriage ink supply station and the printing structure, said fluid conduit including a length of hollow flexible multiple layer tubing, said tubing forming a flexible loop and said multiple layer tubing comprises at least one inner barrier layer of a first material which provides a high barrier to water vapor transmission from ink within the fluid conduit, at least one oxygen barrier layer disposed outwardly of said inner barrier layer and of a second material which has low oxygen permeability, and at least one outer water vapor barrier layer disposed outwardly of said oxygen barrier layer and of a third material which provides a high barrier to water vapor transmission from an ambient atmosphere into the oxygen barrier layer, said multiple layer tubing forming an integrated tubing structure having no air gaps between the inner barrier layer, the oxygen barrier layer and the water vapor barrier layer.

2. The printing system of claim 1 wherein said first material is low density polyethylene.

3. The printing system of claim 1 wherein said first material is high density polyethylene.

4. The printing system of claim 1 wherein said first material is a polyolefin.

5. The printing system of claim 1 wherein said first material is polypropylene.

6. The printing system of claim 1 wherein said second material is ethylene vinyl alcohol.

7. The printing system of claim 1 wherein said second material is polyvinylidene chloride copolymer.

8. The printing system of claim 1 wherein said third material is ethylene vinyl acetate.

9. The printing system of claim 1 wherein said third material is low density polyethylene.

10. The printing system of claim 1 wherein said third material is high density polyethylene.

11. The printing system of claim 1 wherein said third material is polypropylene.

12. The printing system of claim 1 wherein said inner barrier layer and said oxygen barrier layer are joined with a first thin adhesive layer, and said oxygen barrier layer and said outer water vapor barrier layer are joined by a second thin adhesive layer.

13. The system of claim 1 further comprising a supply of ink disposed within said ink reservoir.

14. The printing system of claim 1 wherein said tubing has an inner diameter in a range of 0.100 inch to 0.200 inch.

15. The printing system of claim 2 wherein said inner barrier layer has a wall thickness in a range of 0.015 inch to 0.050 inch.

16. The printing system of claim 2 wherein said inner barrier layer has a wall thickness in a range of 0.02 inch to 0.03 inch.

17. The printing system of claim 6 wherein said oxygen barrier layer has a wall thickness in a range of 0.0005 inch to 0.0100 inch.

18. The printing system of claim 6 wherein said oxygen barrier layer to oxygen permeability has a wall thickness in a range of 0.001 inch to 0.005 inch.

19. The printing system of claim 8 wherein said outer water vapor barrier layer has a wall thickness in a range of 0.005 inch to 0.020 inch.

20. The printing system of claim 8 wherein said outer water vapor barrier layer has a wall thickness in a range of 0.008 inch to 0.012 inch.

21. An ink delivery subsystem for a printer having an off-carriage ink supply, the printer having a media transporting system for transporting a print medium along a medium path to a print area, the printer having a scanning carriage for holding a printing structure including a printhead, the ink delivery subsystem comprising:

an ink reservoir adapted for releasable mounting to a fixed ink supply station;

a fluid outlet in fluid communication with said ink reservoir; and a fluid conduit providing fluid communication between said ink supply station and the carriage to provide an ink replenishment path for the printing structure; said fluid conduit having a conduit length, a portion of said length of said conduit including a length of hollow flexible multiple layer tubing; and said multiple layer tubing comprises at least one inner barrier layer of a first material which provides a high barrier to water vapor transmission from the ink, at least one oxygen barrier layer disposed outwardly of said inner barrier layer and of a second material which has low oxygen permeability, and at least one outer water vapor barrier layer disposed outwardly of said oxygen barrier layer and of a third material which provides a high barrier to water vapor transmission from an ambient atmosphere into the oxygen barrier layer, said multiple layer tubing forming an integrated tubing structure having no air gaps between the inner barrier layers, the oxygen barrier layer and the water vapor barrier layer.

22. The subsystem of claim 21 wherein said first material is low density polyethylene.

23. The subsystem of claim 21 wherein said second material is ethylene vinyl alcohol.

24. The subsystem of claim 21 wherein said second material is polyvinylidene chloride copolymer.

25. The subsystem of claim 21 wherein said third material is ethylene vinyl acetate.

26. The subsystem of claim 21 further comprising a supply of ink disposed within the ink reservoir.

* * * * *